United States Patent [19]

Meijer

[11] Patent Number: 4,825,814

[45] Date of Patent: May 2, 1989

[54] COMBINATION GAS COMBUSTER AND HEAT PIPE EVAPORATOR DEVICE

[75] Inventor: Roelf J. Meijer, Ann Arbor, Mich.

[73] Assignee: Stirling Thermal Motors, Inc., Ann Arbor, Mich.

[21] Appl. No.: 166,321

[22] Filed: Mar. 10, 1988

[51] Int. Cl.[4] ..... F28D 15/02

[52] U.S. Cl. ..... 122/366; 165/104.26; 122/44 A; 122/160; 122/161; 122/182 S

[58] Field of Search ..... 165/104.26; 122/366, 122/142, 160, 161, 182 R, 182 S, 182 T, 44 A, 44 B, 140 A, 155 A

[56] References Cited

U.S. PATENT DOCUMENTS

| | | | |
|---|---|---|---|
| 172,302 | 1/1876 | Dean | 122/44 A |
| 502,729 | 8/1893 | Kreusler | 122/366 |
| 3,853,112 | 12/1974 | Lazaridis et al. | 165/104.26 |
| 3,854,454 | 12/1974 | Lazeridis | 165/104.26 |
| 4,632,179 | 12/1986 | Meijer et al. | 165/104.26 |
| 4,633,820 | 1/1987 | Montini | 122/161 |

*Primary Examiner*—Albert W. Davis, Jr.
*Attorney, Agent, or Firm*—Harness, Dickey & Pierce

[57] ABSTRACT

A combination gas combustor and heat pipe evaporator comprised of elongated cylindrical tubes which overfit one another to create a number of longitudinal gas flow passages. A burner disposed at one end of the device creates hot flue gases which travel initially through an annular passage where heat is conducted to the working fluid of a heat pipe evaporator chamber. The flue gas flow is then reversed in direction to heat the radially outer surface of the tubes making up the heat pipe evaporator, and thereafter flow through passages to warm inlet air to increase combustion efficiency. For both described embodiments, a bellows is provided to accommodate differences in thermal expansion between the tubes making up the heat pipe evaporator. In accordance with a first embodiment, the primary flue gas transport channel has a decreasing annular width with distance from the combuster which results in a lowering Reynolds number for flow which provides a more uniform heat flux along the length of the device. In a second embodiment, the central post is hollow and forms a portion of the heat pipe evaporator. The tubes making up the evaporator chamber may be eccentrically located to provide a narrow bottom gap for longitudinal distribution of liquid phase working fluid and a larger upper gap for escape of vapor phase working fluid.

15 Claims, 2 Drawing Sheets

COMBINATION GAS COMBUSTER AND HEAT PIPE EVAPORATOR DEVICE

BACKGROUND AND SUMMARY OF THE INVENTION

This invention relates to a heating device and particularly to a gas combustor for heating the evaporator portion of a heat pipe.

In the development, testing and evaluation of heat engines such as Stirling cycle engines, an external heat input system frequently is necessary. Such heat input may be provided by using a heat pipe in which a working fluid undergoes vaporization in the evaporator portion of the heat pipe, and is transported to the condensor portion of the heat pipe or a Stirling engine where it condenses, giving up its latent heat of evaporation. The condensed working fluid is thereafter returned to the evaporator portion where the cycle is repeated in a continuous manner. A convenient form of heat energy for such applications is combusted hydrocarbon gases, such as liquified pertroleum gas or propane, etc. Accordingly, there is a need to provide a gas combustor apparatus which efficiently heats the evaporator portion of a heat pupe for providing a heated working fluid to an auxiliary utilization device such as a Stirling cycle engine.

In accordance with this invention, a combination gas combustor and heat pipe evaporator device is provided which features excellent thermal efficiency and is further relatively compact for a given heat transfer capacity. Efficiency of the device is achieved in part by providing a thin annular flue gas escape channel which provides a laminar flow regime for the flue gas which enhances heat transfer efficiency to a heat pipe evaporator. For both of the embodiments described herein, enhanced efficiency is further provided by a counterflow inlet air heat exchanger which provides preheated combustion air which has the effect of boosting flue gas temperature, hereby increasing thermal efficiency.

In a first embodiment of this invention, an annular flue gas discharge channel is provided having a progressively decreasing radial width, which has the effect of decreasing flow Reynolds numbers with decreasing flue gas temperature as a means of causing heat transfer to the heat pipe evaporator to be more uniform along its length. In a second embodiment of this invention, a combination gas combustor and heat pipe evaporator is provided in which both the inner and outer radial walls of the annular flue gas discharge channel form portions of the heat pipe evaporator, which has the effect of reducing the overall length of the combustor device for a given heat transport capacity. Both devices achieve compactness through a construction in which a number of interfitting tubes provide the various fluid flow paths. In addition, means are provided in each embodiment for efficiently distributing liquid heat pipe working fluid along the length of the evaporator to prevent "drying out" of localized areas of the evaporator.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
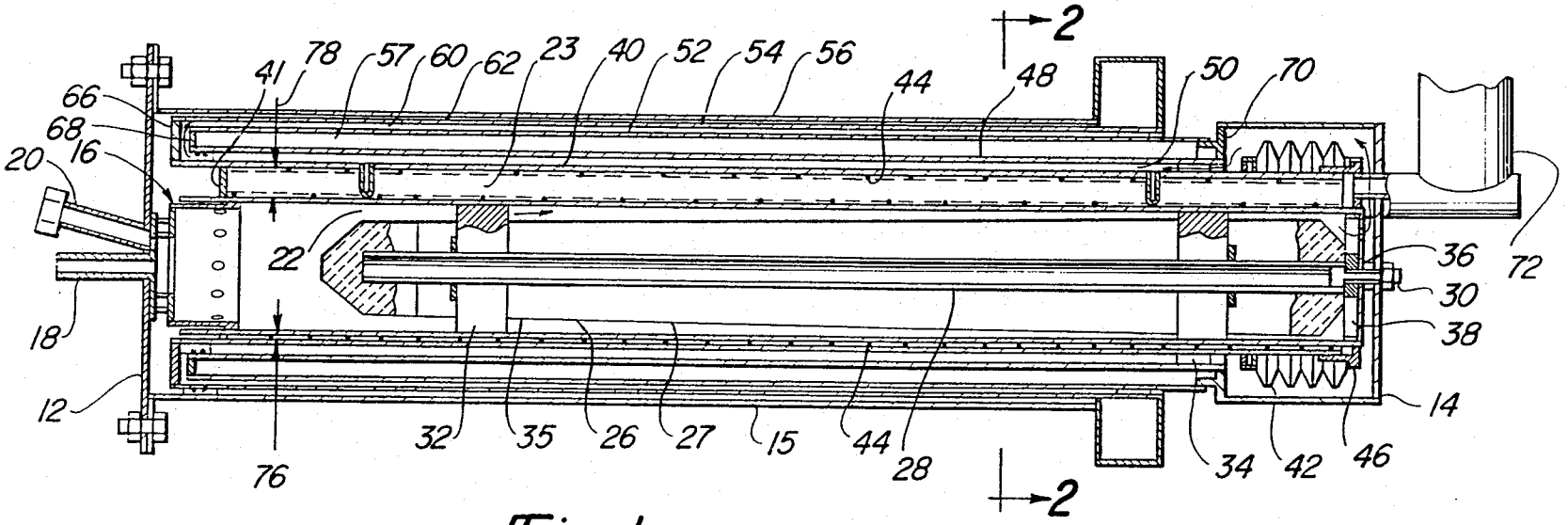
FIG. 1 is a longitudinal cross-sectional view of a combination gas combustor and heat pipe evaporator according to a first embodiment of this invention.
Figure 2:
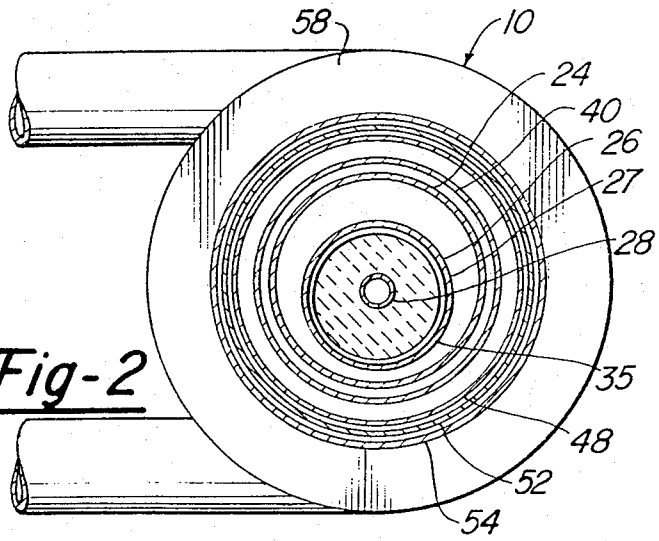
FIG. 2 is a cross-sectional view taken along line 2—2 of FIG. 1.

A combination gas combustor and heat pipe evaporator in accordance with the first embodiment of this invention is shown in FIGS. 1 and 2; and is generally designated by reference number 10. Device 10 is generally cylindrical in shape and has a pair of end plates 12 and 14 which enclose the various cylindrical members disposed within outer shell 15. At the left-hand end of device 10, a centrally disposed burner assembly 16 is provided. Gas port 18 provides a means of introducing a hydrocarbon gas into burner 16. Ignition and inspection port 20 provides access to the burner area for initiating cmbustion and viewing the flame during combustion. Hot flue gases generated by burner 16 initially flow laterally toward the right-hand end of device 10 through primary gas flow passage 22. The radially outer surface of primary gas flow passage 22 is formed by tube 24 which also forms a portion of the heat pipe evaporator 23, as explained in more detail below.

Centrally disposed within primary gas flow passage 22 is post 26 with an outer portion 27 which is made of a refractory material such as a ceramic. Post 26 further includes a central mounting tube 28 which has a threaded end 30 enabling the post to be affixed to end plate 14. Spacers 32 and 34 maintain the radial positioning of post 26. The outer surface 35 of post portion 27 has a conical configuration such that primary gas flow passage 22 has a radial thickness which decreases when traversing from burner 16 toward the right-hand end of device 10.

Bulkhead 36 is located at the extreme right-hand of post 26 and includes apertures 38 for flue gas flow. Tube 40 radially surrounds tube 24 and forms the radially outer wall of heat pipe evaporator 23. Tubes 24 and 40 are rigidly fastened and sealed together at their left-hand ends by wall 41. The opposite end of the tubes 24 and 40 are sealed together by bellows 42 which accommodates differences in longitudinal expansion of the tubes relative to each other, as will be better explained below.

As shown in FIG. 2, tube 24 is not located concentrically within tube 40. Rather, a narrower separation is found at the bottom of the tubes as compared to the top. Furthermore, the right-hand end of tube 40 is not rigidly constrained and is permitted to slide within collar 46. The inside surfaces of both tubes 24 and 40 are lined with wick 44 which serves to distribute the working fluid of heat pipe evaporator 23 in its liquid phase.

Another tube 48 radially surrounds tube 40 and forms secondary flue gas passage 50 which brings the flue gas into thermal contact with the outside surface of tube 40 of evaporator 23. Gas flows through passage 50 in the opposite direction from that through passage 22 (i.e., to the left). An additional three tubes 52, 54, and 56 are also provided which radially envelope each other. The air space 57 between tubes 48 and 52 is provided for thermal insulation between these tubes. The radial space between tubes 52 and 54 provide still another flue gas passage, termed a tertiary gas flow passage 60, which is used for inlet air preheating. The annular gap between the outermost tubes 54 and 56 forms air inlet preheating passageway 62 which communicates with air inlet 58. Annular walls 66, 68 and 70 seal the ends of the various tube members to prevent fluid leakage. Evaporated heat pipe working fluid is removed from evaporator 23 via heat pipe 72 which penetrates end plate 14.

Operation of device 10 will now be explained with reference to FIGS. 1 and 2. Combustion within burner assembly 16 produces high temperature exhaust flue gasses which flow through primary flue gas flow passage 22 in the right-hand direction, as shown in FIG. 1. In accordance with well know heat transfer principles, increased thermal efficiency is provided when gases flow at a low Reynolds number in a laminar flow regime. The narrow thickness of passage 22 and its flow area provide a low Reynolds number. As heat is transferred through wall 24 to the heat pipe working fluid, flue gas temperature decreases as the gases tranverse to the right end of passage 22. The decreasing annular width of passage 22 has the effect of decreasing the Reynolds number of the flow as gas temperature decreases, thus increasing heat transfer efficiency. Accordingly, a more uniform heat transfer rate occurs along the length of tube 24, as compared to the uniform width annular passage. This features tends to reduce the likelihood of overheating heat pipe evaporator 23 near burner assembly 16, which can cause the evaporator to "dry out" in localized areas leading to potential failure of the evaporator.

Once the flue gases reach the right-hand extremity of passage 22, it flows radially outwardly along end plate 14, and then through secondary flue gas passageway 50 where it continues to transfer heat into heat pipe evaporator 23. Once the flue gases reach the left-hand end in secondary flue passage 50, it again moves radially outwardly and then flows through tertiary passageway 60.

Inlet combustion air flowing in passage 62 gains heat as it flows to the left end of the device due to the counterflow heat transfer arrangement provided with the exhausting flow gases flowing through tertiary passage 60.

During initial start-up of device 10, a significant difference in temperature may exist between tubes 24 and 40, since the initially discharged flue gas will rapidly increase the temperature of tube 24 before the working fluid within heat pipe evaporator 23 increases in temperature. Such difference in temperature between tubes 24 and 40 causes an uneven degree of longitudinal thermal expansion of the tubes. If these two tubes were to be ridigly constrained at both their axial ends, mechanical failure could result at their interconnections. Accordingly, bellows 42 and collar 46 provides a means for permitting relative movement between the tubes while containing the working fluid of evaporator 23.

FIG. 2 illustrates the eccentric positioning of tube 24 within tube 40. This orientation provides a narrow radial gap distance, designated by reference number 76, along the bottom of heat pipe evaporator 23, and a larger radial gap distance, designated by 78, at the top of the heat pipe. These differing spacings are provided to enhance working fluid transport along the axial length of heat pipe evaporator 23. Since all of the heat pipe working fluid is introduced via heat pipe inlet 72, an efficient means for transporting liquid phase working fluid longitudinally is desired to avoid the above mentioned "drying out" conditions. Due to the existence of narrow gap 76, the liquid working fluid collects at the bottom of heat pipe evaporator 23 and forms a longitudinal liquid pool which extends across the entire length of the evaporator which enables the liquid to be transported longitudinally in an efficient manner by capillary action through wick 44. The larger upper gap 78 enables the free flow of vaporized working fluid which flows at a relatively low velocity to reduce the tendency of liquid working fluid to become entrained within the working fluid vapor.

Figure 3:
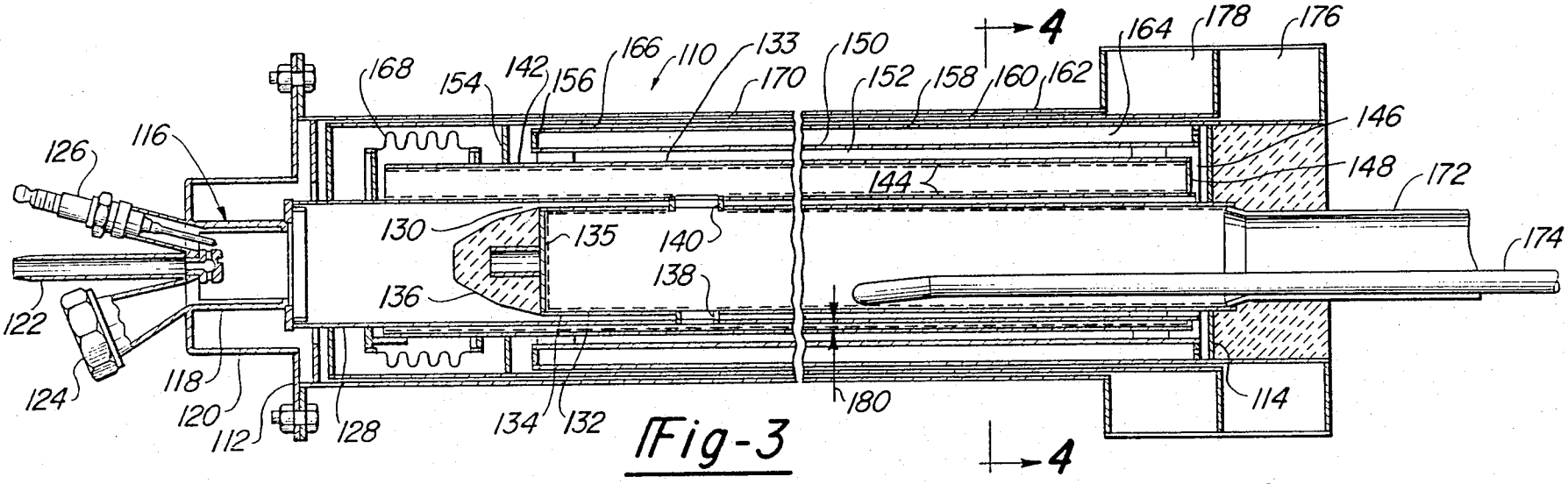
FIG. 3 is a longitudinal cross-sectional view of a combination gas combustor and heat pipe evaporator according to a second embodiment of this invention.
Figure 4:
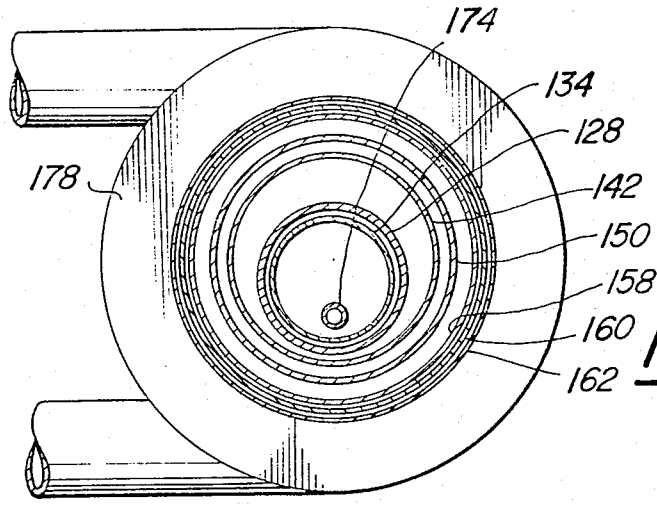
FIG. 4 is a cross-sectional view taken along line 4—4 of FIG. 3.

A combination gas combustor and heat pipe evaporator device according to a second embodiment of this invention is shown in FIGS. 3 and 4 and is generally designated by reference number 110. Device 110, like the above described embodiment of this invention, is a generally cylindrical device made of a number of interfitting tubular members bounded by end plates 112 and 114. Burner assembly 116 is formed by tubular member 118 and 120 and includes gas inlet 122, inspection port 124, and spark ignitor 126. Like the first embodiment, a tubular member 128 forms a boundary of primary flue gas passage 130. For this embodiment, however, central post 132 forms a portion of heat pipe evaporator 133 and is made from tube 134 which has end plate 135 with attached nose cone 136 made from a refractory material. Working fluid within heat pipe evaporator 133 flows between the inside of tube 134 and the outside of tube 128 via radial passages 138 and 140.

Evaporator tube 142 overfits tube 128 which is eccentrically located, as described in connection with the evaporator of the first embodiment. The radially inner surface of tubes 134 and 142, and the radially outer surface of tube 128 are lined with wick 144, which performs a liquid working fluid transport function, as previously discussed. An end gap 146 is provided between end plate 114 and wall 148 as a radial flue gas transport channel. The annular space between tubes 142 and 150 forms a secondary exhaust gas transport channel 152 for additional heat transfer to heat pipe evaporator 133 and terminates at walls 154 and 156. Three additional interfitting tubes are provided, 158, 160, and 162, for forming an insulating gap 164 and a tertiary flue gas passage 166 for preheating of air flowing through passage 170 as described in connection with the first embodiment. Device 110 forms annular exhaust mnaifold 176 communicating with flue gas passage 166, and manifold 178 for inlet air. Bellows 168 couples tubes 128 and 142 to accommodate thermal expansion, as previously described.

For this embodiment, the phases of the heat pipe working fluid are separated such that outward flow of vapors occurs through tube 172, whereas returned liquid working fluid flows through smaller diameter tube 174.

In operation, hot flue gas first flows through primary flow channel 130 where it heats heat pipe evaporator 133 through tubes 128 and 134. For this embodiment, primary flue gas passage 130 has a constant radial width along its entire length which does not provide the uniform heat transfer rate of the first embodiment, but does provide manufacturing advantages. As with the prior embodiment, secondary gas flow passage 152 heats the radially outer wall of the heat pipe evaporator 133 through tube 142 to conduct additional heat. Likewise, air preheaitng is provided in a manner identical to that of the first embodiment. Liquid heat pipe working fluid being returned via tube 174 is deposited along wick 144 inside tube 134. The liquid working fluid becomes distributed along the bottom surface of tube 134 and a portion of the liquid is permitted to drain through radial tube 138 where it can wet the narrow gap 180 provided between tubes 128 and 142, and becomes laterally distributed as described in connection with the first embodiment. Nose cone 136 isolates end plate 135 from the intense temperatures which would result if the flue gases could reach a stagnation condition at the end plate surface. Such stagnation would cause intense heating of the heat pipe evaporator 133 at localized areas which could lead to drying out of portions of the evaporator, potentially leading to mechanical failure. Vaporized heat pipe working fluid generated in the area between tubes 128 and 142 passes through gas passage 140 and out through tube 172.

While the above description constitutes the preferred embodiments of the present invention, it will be appreciated that the invention is susceptible to modification, variation and change without departing from the proper scope and fair meaning of the accompanying claims.

What is claimed is:

1. A combination gas combustor and heat pipe evaporator device comprising:

a first tube, combustor means for generating hot flue gases flowing inside said first tube, a post inside said first tube for defining an annular primary flue gas flow passage between said post and said first tube, a second tube overfitting said first tube, and first and second tubes defining an enclosed heat pipe evaporator chamber, wick means lining said first and second tubes within said heat pipe evaporator chamber for distributing a heat pipe working fluid, a third tube overfitting said second tube forming a secondary flue gas flow passage communicating with said primary flue gas flow passage whereby said flue gas transfers heat to said heat pipe evaporator chamber through said first and second tubes, and pipe means for transporting said heat pipe working fluid in the liquid phase into said evaporator chamber, and for transporting said working fluid in the vapor phase out of said evaporating chamber.

2. A combination gas combustor and heat pipe evaporator device according to claim 1 wherein said first and second tubes are eccentrically positioned and oriented in a horizontal direction to define a narrow separation gap at their lower end and a wider separation gap at their upper end, whereby said liquid phase working fluid is transported longitudinally along said lower end and said vapor phase working fluid is vented out of said evaporator chamber through said wider gap.

3. A combination gas combustor and heat pipe evaporator device according to claim 1 wherein said device further comprises fourth, fifth, and sixth tubes overfitting said third tube and defining a tertiary flue gas flow passage communicating with said secondary flue gas flow passage, and further defining an inlet air preheating passage thermally communicating with said tertiary flue gas flow passage.

4. A combination gas combustor and heat pipe evaporator device according to claim 3 wherein said third and fourth tubes define an annular insulating air gap.

5. A combination gas combustor and heat pipe evaporator device according to claim 1 wherein said post is formed from a refractory material.

6. A combination gas combustor and heat pipe evaporator device according to claim 1 wherein said post is a hollow tubular member fluidically communicating with said evaporator chamber between said first and second tube member to form a portion of said evaporator chamber.

7. A combination gas combustor and heat pipe evaporator device according to claim 1 wherein said annular primary flue gas flow passage has a radial width which decreases with distance from said combustor means.

8. A combination gas combustor and heat pipe evaporator device according to claim 1 further comprising bellows means connecting said first and second tubes to define said evaporator chamber while permitting differences in longitudinal expansion of said first and second tubes.

9. A combination gas combustor and heat pipe evaporator device comprising:

a post having a hollow internal first evaporator chamber, a first tube overfitting said post thereby defining an annular primary flue gas flow channel between said post and said first tube, combustor means for generating hot flue gas flowing inside said first tube, a second tube overfitting said first tube defining second evaporator chamber, conduit means for connecting said first evaporator chamber with said second evaporator chamber, wick means lining the inside surfaces of said evaporator chambers, a third tube overfitting said second tube forming a secondary flue gas flow passage communicating with said primary flue gas flow passage whereby said flue gas transfers heat to said heat pipe evaporator chambers through said first and second tubes, and pipe means for transporting said heat pipe working fluid in the liquid phase into said evaporator chambers, and for transporting said working fluid in the vapor phase out of said evaporator chambers.

10. A combination gas combustor and heat pipe evaporator device according to claim 9 wherein said first and second cylindrical tubes are eccentrically positioned and oriented in a horizontal direction to define a narrow separation gap at thier lower end and a wider separation gap at their upper end, whereby said liquid phase working flud is transported longitudinally along said lower end and said vapor phase working fluid is vented out of said evaporator chambers through said wider gap.

11. A combination gas combustor and heat pipe evaporator device according to claim 9 wherein said device further comprises fourth, fifth, and sixth cylindrical tubes overfitting said third tube and defining a tertiary flue gas flow passage communicating with said secondary flue gas flow passage, and further defining an inlet air preheating passage thermally communicating with said tertiary flue gas flow passage.

12. A combination gas combustor and heat pipe evaporator device according to claim 11 wherein said third and fourth tubes defining an annular insulating air gap.

13. A combination gas combustor and heat pipe evaporator device according to claim 9 wherein said post includes a nose cone adjacent said combustor means to prevent overheating of the end of said post.

14. A combination gas combustor and heat pipe evaporator device according to claim 9 wherein said annular primary flue gas flow passage has a radial width which decreases with distance from said combustor means.

15. A combination gas combustor and heat pipe evaporator device according to claim 9 further comprising bellows means connecting said firs and second tubes to defining said evaporator chamber while permitting differences in longitudinal expansion of said first and second tubes.

* * * * *

UNITED STATES PATENT AND TRADEMARK OFFICE

CERTIFICATE OF CORRECTION

PATENT NO. : 4,825,814

DATED : May 2, 1989

INVENTOR(S) : Roelf J. Meijer

It is certified that error appears in the above-identified patent and that said Letters Patent is hereby corrected as shown below:

ON THE TITLE PAGE, in the title, "COMBUSTER" should be --COMBUSTOR--.
In the Abstract, Line 17, "combuster" should be --combustor--.

Column 1, line 1, in the title, "COMBUSTER" should be --COMBUSTOR--.

Column 1, line 16, "condensor" should be --condenser--.

Column 1, line 26 , "pupe" should be --pipe--.

Column 2, line 27, "cmbustion" should be --combustion--.

Column 2, line 45, after "right-hand" insert --end--.

Column 3, line 12, after "pipe" insert --tube--.

Column 3, line 24, "tranverse" should be --transverse--.

Column 3, line 31, "features" should be --feature--.

Column 3, line 46, "flow" should be --flue--.

Column 3, line 56, "ridigly" should be --rigidly--.

Column 4, line 49, "mnaifold" should be --manifold--.

Column 5, line 1, "preheaitng" should be --preheating--.

Column 5, line 35, "and" (first occurrence) should be --said--.

UNITED STATES PATENT AND TRADEMARK OFFICE

CERTIFICATE OF CORRECTION

PATENT NO. : 4,825,814

DATED : May 2, 1989

INVENTOR(S) : Roelf J. Meijer

It is certified that error appears in the above-identified patent and that said Letters Patent is hereby corrected as shown below:

Column 5, line 50, "evaporating" should be --evaporator--.

Column 6, line 52, "thier" should be --their--.

Column 6, line 54, "flud" should be --fluid--.

Column 8, line 5, "firs" should be --first--.

Signed and Sealed this

Twenty-second Day of January, 1991

*Attest:*

HARRY F. MANBECK, JR.

*Attesting Officer*

*Commissioner of Patents and Trademarks*